US006561642B2

(12) United States Patent
Gonzalez

(10) Patent No.: US 6,561,642 B2
(45) Date of Patent: May 13, 2003

(54) INK JET PRINTER SYSTEM FOR PRINTING AN IMAGE ON A WEB OVERLAYING A REMOVABLE SUBSTRATE AND METHOD OF ASSEMBLING THE PRINTER SYSTEM

(75) Inventor: Charlene Gonzalez, Escondido, CA (US)

(73) Assignee: Hewlett-Packard Development Company, Houston, TX (US)

( * ) Notice: Subject to any disclaimer, the term of this patent is extended or adjusted under 35 U.S.C. 154(b) by 102 days.

(21) Appl. No.: 09/965,994

(22) Filed: Sep. 28, 2001

(65) Prior Publication Data

US 2003/0063173 A1 Apr. 3, 2003

(51) Int. Cl.[7] ..... B41F 17/10; B41J 2/01; B41J 3/407

(52) U.S. Cl. ..... 347/104; 347/2

(58) Field of Search ..... 347/104, 171, 347/2, 4, 1

(56) References Cited

U.S. PATENT DOCUMENTS

| | | | | |
|---|---|---|---|---|
| 4,490,728 A | | 12/1984 | Vaught et al. | |
| 5,670,005 A | * | 9/1997 | Look et al. | 156/230 |
| 6,015,454 A | | 1/2000 | Lacroix et al. | |
| 6,033,066 A | | 3/2000 | Koike et al. | |
| 6,071,368 A | | 6/2000 | Boyd et al. | |
| 6,085,818 A | * | 7/2000 | Takizawa et al. | 156/387 |
| 6,153,263 A | | 11/2000 | Haruta et al. | |
| 6,224,204 B1 | | 5/2001 | Aoki | |
| 6,233,982 B1 | | 5/2001 | Thies | |
| 6,254,231 B1 | | 7/2001 | Suzuki et al. | |
| 6,312,123 B1 | * | 11/2001 | Codos et al. | 347/102 |
| 6,467,898 B2 | * | 10/2002 | Codos et al. | 347/102 |
| 2001/0038408 A1 | * | 11/2001 | Codos et al. | 347/102 |
| 2002/0005870 A1 | * | 1/2002 | Codos et al. | 347/9 |
| 2002/0044188 A1 | * | 4/2002 | Codos et al. | 347/106 |
| 2002/0047263 A1 | * | 4/2002 | McCarthy et al. | 283/107 |

* cited by examiner

*Primary Examiner*—Huan Tran
(74) *Attorney, Agent, or Firm*—Walter S. Stevens

(57) ABSTRACT

Ink jet printer system for printing an image on a web overlaying a removable substrate and method of assembling the printer. The ink jet printer system comprises an ink jet print head for jetting ink onto the web to form an image on the web. A feeder mechanism is coupled to the print head for feeding the web and substrate past the print head during printing. A first roller is aligned with the feeder mechanism and is adapted to engage the substrate for removing the substrate from the web. A second roller is aligned with the first roller, the second roller being adapted to layer a covering onto the printed image as the first roller removes the substrate from the web. A third roller is aligned with the second roller for supplying the covering to the second roller. In this manner, a layered web is defined. Moreover, a steaming core is provided to bundle-up the layered web, so that a steaming roll is defined thereby. A steam generator receives the steaming roll and generates steam for fixing the ink to the layered web that belongs to the steaming roll. The covering is removed from the layered web to define a bare web. Further, a washer is disposed to wash the bare web for removing unfixed ink from the bare web. Also, a hot-air blower directs heated air onto the bare web for drying the bare web. A take-up reel may also be provided to engage the bare web and wrap the bare web thereabout for packaging the bare web for shipment.

54 Claims, 7 Drawing Sheets

INK JET PRINTER SYSTEM FOR PRINTING AN IMAGE ON A WEB OVERLAYING A REMOVABLE SUBSTRATE AND METHOD OF ASSEMBLING THE PRINTER SYSTEM

BACKGROUND OF THE INVENTION

The present invention generally relates to ink jet printer apparatus and methods therefor and more particularly relates to an ink jet printer system for printing an image on a web overlaying a removable substrate, and method of assembling the printer system.

It is known to print colorful images on woven and unwoven textiles or fabrics such as cotton, wool, silk, synthetics, and the like prior to the fabrics being cut and sewn. Of course, the fabrics are cut and sewn to provide articles for everyday use, such as clothing, towels, upholstery and other articles.

Various printing techniques are used to produce the images that appear on the fabric. One technique is to use the well-known process of screen printing, wherein a screen serving as a stencil and having a predetermined mesh count is coated with ink of a desired color. It is the back of the screen that is coated with ink. The article to be screen printed is then placed on the front of the screen and a squeegee blade is pressed against the back of the screen to work the ink into the article. In this manner, the image is printed onto the article.

However, use of screen printing has several disadvantages. For example, screen printing is unsuitable for quickly changing images to be printed in order to keep-up with changes in consumer taste. Also, time required to set-up or construct a particular screen stencil and mix the desired ink color in order to print particular image makes screen printing not cost-effective for small quantity production runs. In other words, screen printing is not cost-effective for a large number of small production runs because of the increased frequency of screen set-ups.

Another well-known technique for printing images on fabrics is use of a plate roller having the image engraved on the plate in reverse relief In this regard, ink of a desired color is applied to the plate and the plate is then rolled against the fabric to be printed in order to form the image on the fabric. However, use of the plate roller technique is relatively expensive because the plate roller technique typically uses a rotogravure printing process, which requires fabrication of an intaglio plate prepared by photographic methods. Of course, an intaglio plate is an engraving etched deeply into a surface of a hard material, which is typically metal. Also, time required to engrave the plate in order to print a particular image makes plate roller printing not cost-effective for small quantity production runs. In other words, plate roller printing is not cost-effective for smaller production runs because each article is printed from one engraving of the plate and smaller production runs would increase frequency of engraving and production set-ups.

Therefore, the commercial fabric printing industry is shifting from screen printing and plate roller printing of fabrics to ink jet printing of fabrics. Ink jet printing of fabrics offers several advantages over screen printing and plate roller printing. That is, ink jet printing allows immediate changes in color and design of an image in order to rapidly adjust to consumer tastes. This is so because ink channels formed in the ink jet print head can be selectively enabled depending on the particular image to be printed at that moment. In other words, ink jet printing is well-suited to small production runs as well as large production runs because ink jet printing does not require time-consuming and expensive fabrication and deployment of a screen stencil or an engraved plate every time the design of the image is changed.

However, although not all ink jet printers require fabrics to be stiffened, it has been observed that fabric to be printed by an ink jet printer typically needs stiffening in order to properly feed through the printer's feeding mechanism. This is so because the fabric is inherently quite flexible in both the longitudinal and transverse directions. This inherent flexibility of the fabric may result in misalignment of the fabric or even "jamming" of the fabric in the printer as the fabric feeds through the printer. Misalignment of the fabric produces images of inconsistent quality and "jamming" of fabric in the printer causes the printer to cease operation, at least until the "jammed" fabric is cleared. Therefore, a common practice in the art of ink jet printing of fabrics is to provide a substrate, such as a relatively stiff paper backing material, coupled to the fabric. This backing material may be adhered to the fabric by a suitable adhesive. The backing material is selected for its thickness and stiffness, such that the fabric with backing material has sufficient stiffness in the longitudinal and transverse directions to properly feed through the printer.

However, this solution to the previously mentioned "stiffness" problem in turn gives rise to another problem in the art. That is, it is preferable to remove the relatively stiff backing material from the fabric prior to the fabric being cut and sewn. In the prior art, removal of the backing material is accomplished manually. That is, typically an attendant assigned to operate the printer manually grasps the fabric and backing material after printing and then peels the backing material from the fabric. The backing material is discarded by the attendant. Hence, time and labor are expended to remove the backing material. Therefore, it is desirable to avoid manual removal of the backing material in order to save time and labor.

Apparatus and methods for ink jet printing of textiles having a removable backing layer are known. Such an apparatus and method are disclosed by U.S. Pat. No. 6,071,368 titled "Method And Apparatus For Applying A Stable Printed Image Onto A Fabric Substrate" issued Jun. 6, 2000 in the name of Melissa D. Boyd, et al. and assigned to the assignee of the present invention. The Boyd, et al. patent discloses an ink transfer sheet including a backing layer, a detachable release layer on the backing layer, and an ink receiving layer on the release layer. According to the Boyd, et al. patent, the backing layer provides support for the other layers while the release layer is used to adhere the ink receiving layer and printed image onto a fabric substrate. The ink receiving layer is formulated to allow adhesion and/or absorption of ink materials thereon so that a defined printed image can be effectively transferred. In this regard, once the ink composition is delivered to the ink receiving layer of the transfer sheet, the transfer sheet is placed on and against the selected fabric substrate so that the ink receiving layer and the printed image are in physical contact with the substrate. Heat is applied to the transfer sheet to cause the release layer and ink receiving layer to adhere to the fabric substrate. After or during application of heat, the backing layer is removed (e.g., by physical detachment or "peeling") from the ink transfer sheet. The release layer and receiving layer are left on the fabric substrate so that the printed image is transferred to the fabric substrate. However, although the Boyd, et al. patent discloses removing the backing layer from the fabric substrate, the Boyd, et al. patent does not disclose structure to accomplish this result and therefore does not disclose a solution to the problem of manual removal of the backing layer.

Another ink jet printing apparatus and method for fabric printing are disclosed by U.S. Pat. No. 6,254,231 B1 titled "Ink-Jet Textile Printing Ink And Ink-Jet Printing Process And Instrument Making Use Of The Same" issued Jul. 3, 2001 in the name of Mariko Suzuki, et al. The Suzuki, et al. patent discloses an ink-jet printing process that includes the steps of applying an ink to a cloth in accordance with an inkjet system, subjecting the cloth to a reactive fixing treatment, and then washing the cloth thus treated to remove unreacted dye. However, the Suzuki, et al. patent does not disclose that the fabric has a backing material and therefore does not disclose a solution to the problem of manually removing the backing material.

Hence, a problem in the art is the practice of manual removal of the backing material from fabric printed by an ink jet printer.

Therefore, what is needed is an ink jet printer system for printing an image on a web overlaying a removable substrate, and method of assembling the printer system, the printer system being capable of removing the substrate from the web.

SUMMARY OF THE INVENTION

The present invention generally resides in an ink jet printer system for printing an image on a web overlaying a removable substrate, comprising: a print head for jetting ink onto the web; a feeder mechanism associated with the print head for feeding the web and substrate past the print head; and a first work station associated with the feeder mechanism for removing the substrate.

According to an aspect of the present invention, the ink jet printer system comprises an ink jet print head for jetting ink onto the web to form an image on the web. Coupled to the web is a substrate. A feeder mechanism is coupled to the print head for feeding the web and substrate past the print head during printing. A first roller is aligned with the feeder mechanism and is adapted to engage the substrate for mechanically removing the substrate from the web. A second roller is aligned with the first roller, the second roller being adapted to layer a covering onto the printed image as the first roller removes the substrate from the web. The web with layered covering defines a layered web. The covering is provided to protect the printed image from damage during subsequent handling and to prevent "bleed through" of the image, as discussed presently. In addition, a third roller is aligned with the second roller for supplying the covering to the second roller. Moreover, a steaming core is provided to bundle-up the layered web, so that a steaming roll is defined thereby. A steam generator receives the steaming roll and generates steam for fixing the ink to the layered web. The previously mentioned covering separates successive layers of the web when bundled in the form of the steaming roll. In this manner, ink from the top surface of the web in one layer of the steaming roll will not contact the bottom surface of the web in an adjacent layer of the steaming roll. Further, the covering is removed from the layered web and a washer is preferably disposed to then wash the web for removing unfixed ink from the web. Also, a hot-air blower directs heated air onto the web for drying the web. A take-up reel may also be provided to engage the web and wrap the web thereabout in order to package the web for shipment.

A feature of the present invention is the provision of a first roller aligned with the feeder mechanism and adapted to engage the substrate for mechanically removing the substrate from the web.

An advantage of the present invention is that use thereof decreases total printing time, labor and expense.

Another advantage of the present invention is that use thereof decreases likelihood of damage to the web, which in turn decreases wastage.

These and other features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing-out and distinctly claiming the subject matter of the present invention, it is believed the invention will be better understood from the following description when taken in conjunction with the accompanying drawings wherein:

DETAILED DESCRIPTION OF THE PREFERRED EMBODIMENT

Figure 1:
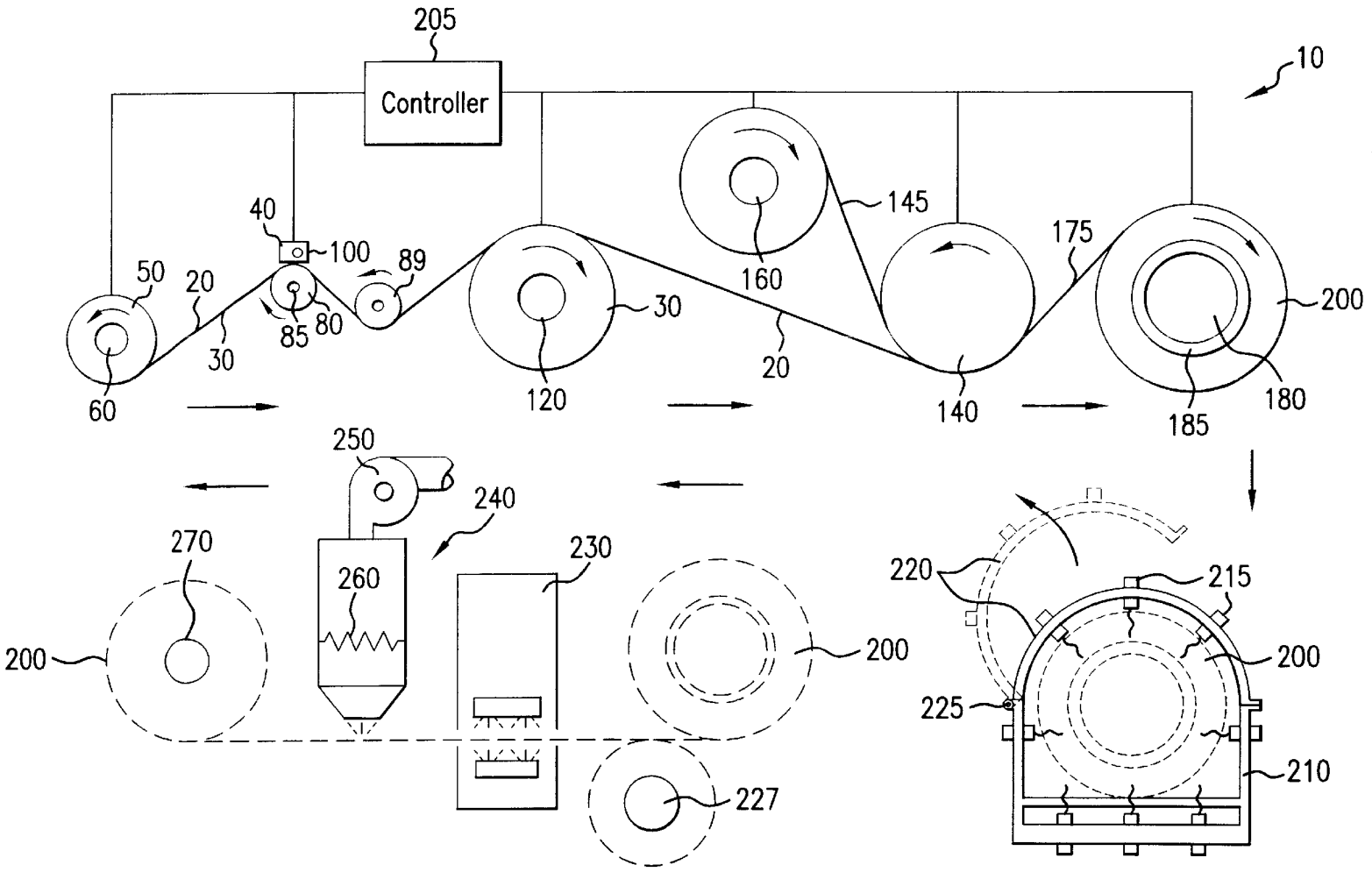
FIG. 1 is a view in elevation of an ink jet printer system according to the present invention with parts removed for clarity, the printer system being capable of printing an image on a web material, such as fabric.

The present invention will be directed in particular to elements forming part of, or cooperating more directly with, apparatus in accordance with the present invention. It is to be understood that elements not specifically shown or described may take various forms well known to those skilled in the art.

Therefore, referring to FIGS. 1, 2, 3 and 4, there is shown an ink jet printer system, generally referred to as 10, for printing an image 15 on a web 20 overlaying a removable substrate 30. By way of example only and not by way of limitation, web 20 may be a textile or fabric such as cotton, wool, silk or synthetic textile material. However, although the description herein is with reference to web 20 being a textile or fabric, it will be appreciated that web 20 may be any suitable material that overlays a removable substrate and upon which image 15 is to be formed. Moreover, substrate 30 is selected so that it is sufficiently strong and stiff in order that web 20 moves effortlessly through printer system 10 in a manner disclosed more fully hereinbelow. In this regard, substrate 30 may have a thickness of about 0.04 to 0.16 mm and be made of any suitable material such as paper, polyester, cellophane, nylon, or other material.

Referring to FIGS. 1, 2, 3, 4 and 5, substrate 30 with web 20 overlaid thereon is presented to a print head 40 in the form of a roll 50 wound about a rotatable spindle 60. The spindle 60 may be rotated by means of a first motor 65. Prior to start of printing, an end portion of web 20 and substrate 30 are positioned adjacent to print head 40 by any convenient means well known in the art, such as manually or by mechanical means (not shown). Moreover, print head 40 itself is preferably a thermal ink jet print head having a plurality of aligned ink channels 70*a*, 70*b* and 70*c* formed therein (only three of which are shown). Of course, it may be appreciated that print head 40 may be a piezoelectric print head. Each channel 70*a*, 70*b* and 70*c* terminates in a channel orifice 72a, 72*b* and 72*c*, respectively. In addition, each ink channel 70*a*, 70*b* and 70*c* preferably contains a differently colored ink 75*a*, 75*b* and 75*c*, respectively, consisting of a dye or pigment dispersion. In this regard, inks 75*a*, 75*b* and 75*c* may possess a red, blue and yellow color, respectively, if desired.

Referring again to FIGS. 1, 2, 3, 4 and 5, during printing, web 20 and substrate 30 are supported and fed past print head 40 by a feeder mechanism. For example, the feeder mechanism may be a generally cylindrical platen 80 preferably rotatable on an axle 85 and positioned opposite orifices 72*a*, 72*b* and 72*c*. Axle 85 may be rotated by means of a second motor 87. In addition, a tensioner, such as a capstan roller 89, may be provided to engage web 20 and substrate 30 for tensioning web 20 and substrate 30. Tensioning web 20 and substrate 30 in this fashion reduces risk of fouling (i.e., "jamming") of web 20 and substrate 30 between print head 40 and platen 80. During operation of thermal ink jet print head 40, a multiplicity of ink drops 90 (only one of which is shown) are selectively jetted from orifices 72*a*, 72*b* and 72*c* and onto web 20 in order to form image 15. Ink drops 90 are preferably jetted onto web 20 by selective explosive formation of a vapor bubble (not shown) in channels 70*a*, 70*b* and/or 70*c* to selectively jet ink drops 90 from channels 70*a*, 70*b* and/or 70*c*. As well-known in the art, the vapor bubble is formed due to application of an electrical pulse to a plurality of resistors in respective fluid communication with each of inks 75*a*, 75*b* and 75*c*. The principal of operation of such a thermal ink jet print head is disclosed more fully in U.S. Pat. No. 4,490,728 titled "Thermal Ink Jet Printer" issued Dec. 25, 1984 in the name of John L. Vaught, et al. and assigned to the assignee of the present invention, the disclosure of which is hereby incorporated by reference.

Figure 3:
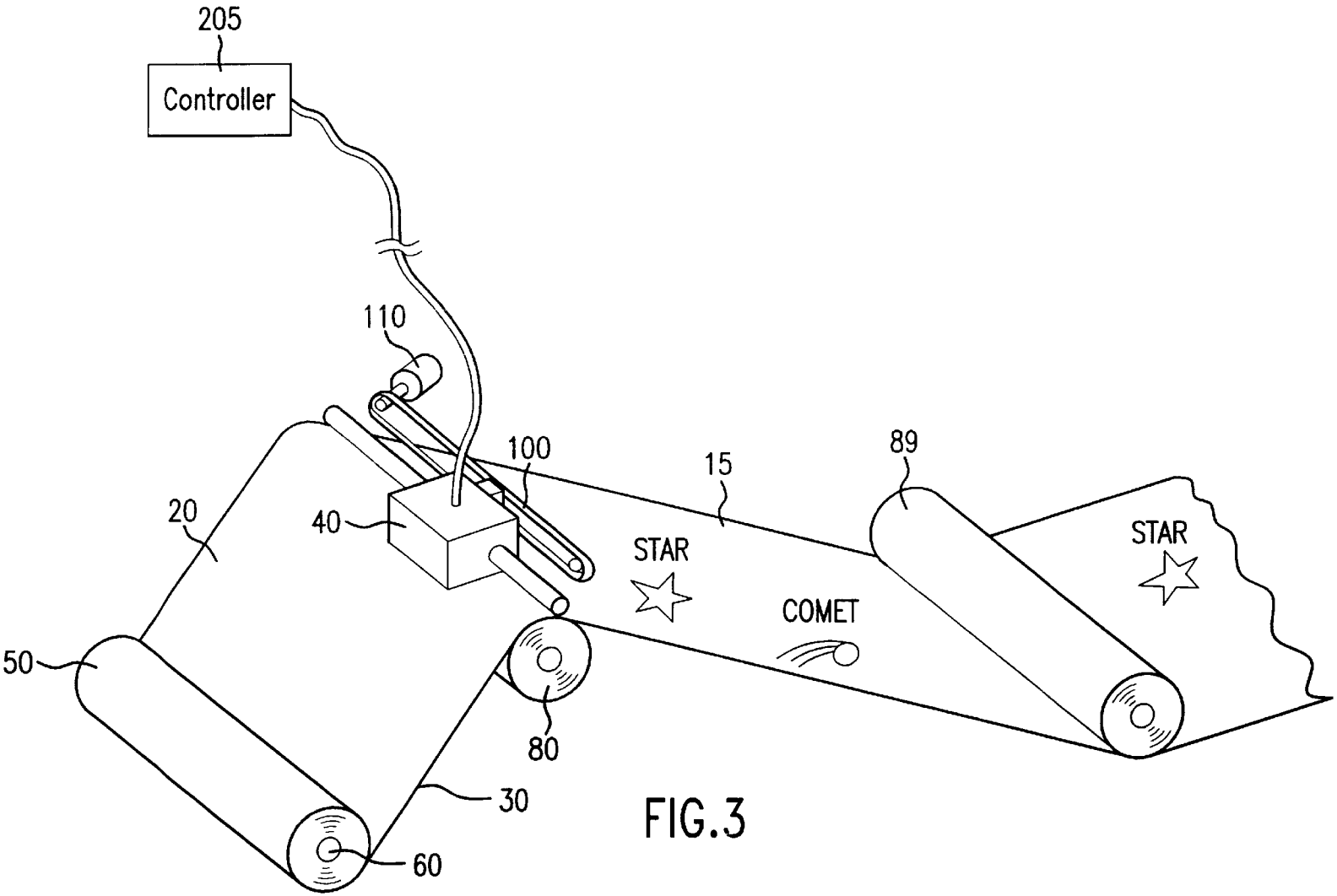
FIG. 3 is a view in perspective of an ink jet print head printing the image on the web in raster-like fashion.
Figure 4:
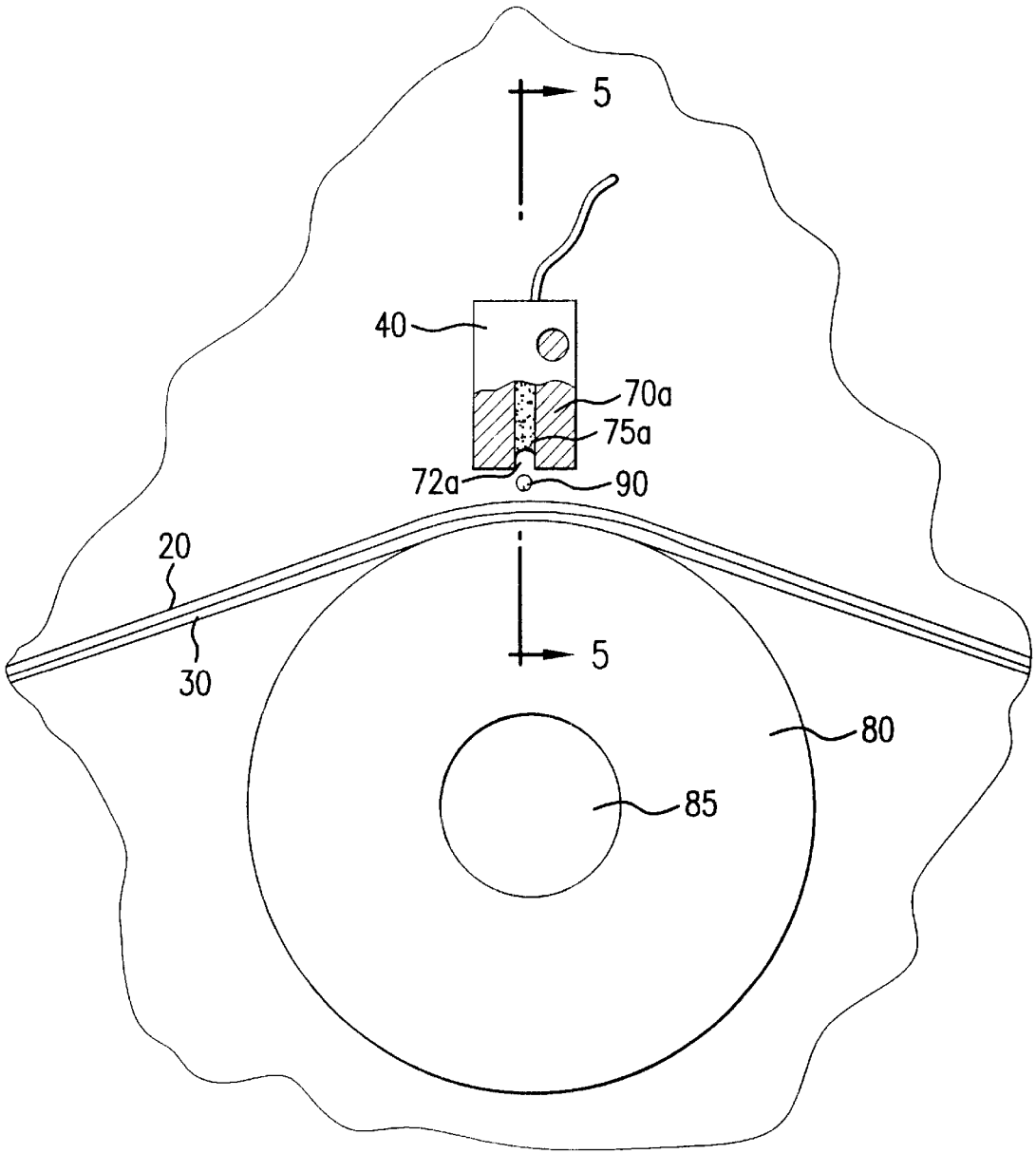
FIG. 4 is a fragmentation view in partial elevation of the ink jet print head jetting an ink drop onto the web, which web has a substrate coupled thereto.
Figure 5:
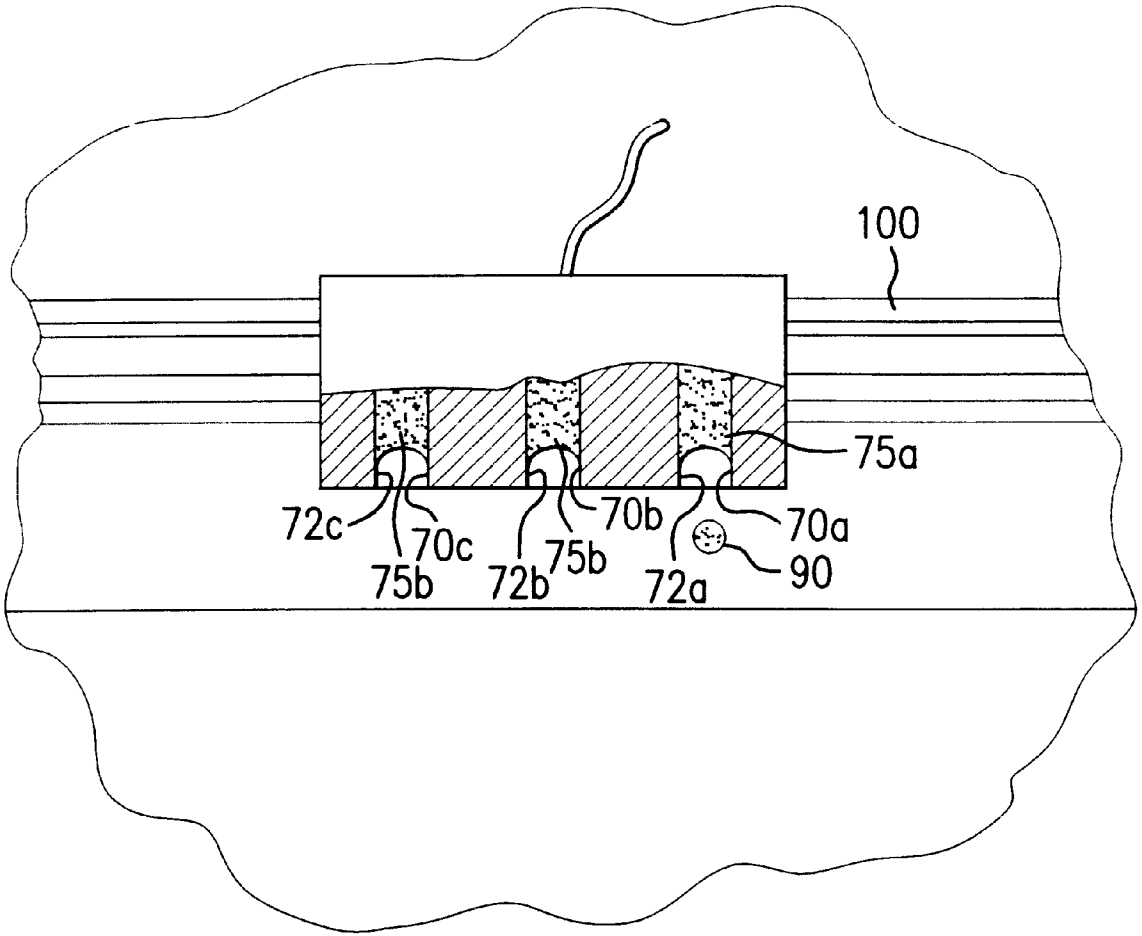
FIG. 5 is a view in partial elevation taken along section line 5—5 of FIG. 4.

As best seen in FIG. 3, print head 40 may threadably engage a belt drive 100 rotatable by means of a third motor 110. As belt drive 100 rotates, print head 40 will traverse web 20 while channels 70*a*, 70*b* and/or 70*c* selectively jet ink drops 90 onto web 20. Of course, platen 80 is rotated to advance web 20 each time print head 40 traverses web 20 and jets ink drops 90 onto web 20. In this manner image 15 is formed on web 20 in a raster-like fashion. Although belt drive 100 is shown for enabling print head 40 to traverse web 20, other motive means may be used, such a screw-drive mechanism (not shown).

Alternatively, print head 40 may be a piezoelectric print head rather than a thermal ink jet print head, if desired. In this regard, such a piezoelectric print head also includes channels 70*a*/*b*/*c* terminating in channel orifices 72*a*/*b*/*c*, respectively. However, in this instance, print head 40 is made of a piezoelectric material and ink is selectively jetted from orifices 72*a*/*b*/*c* by means of an electric pulse selectively applied to the piezoelectric material comprising each channel 70*a*/*b*/*c*. Due to the inherent nature of piezoelectric material, walls of selected ones of channels 70*a*/*b*/*c* inwardly move when the walls are electrically stimulated. As the walls of the selected channels respond to the electric stimulus by inwardly moving, ink drops 90 are jetted from their corresponding orifices. A representative piezoelectric print head is disclosed in U.S. Pat. No. 6,193,343 titled "Driving Method Of An Ink Jet Printhead" issued Feb. 27, 2001 in the name of Norigoe, et al.

As previously mentioned, it is important to remove (i.e., peel) the relatively stiff substrate 30 from web 20. This is important in order to prepare the fabric material of web 20 for cutting and sewing. In the prior art, removal of the substrate 30 (i.e., backing material) is accomplished manually. That is, typically an attendant assigned to operate printer system 10 manually grasps web 20 (e.g., fabric) and substrate 30 (i.e., backing material) after printing and then peels substrate 30 from the entirety of web 20. However, this technique of removing substrate 30 results in increased total printing time, labor and expense. Moreover, this technique of removing substrate 30 increases likelihood of damage to fabric web 20, which in turn increases wastage. Consequently, it is desirable to avoid manual removal of substrate 30 in order to save time, labor and expense and to avoid damage to fabric web 20.

Figure 2:
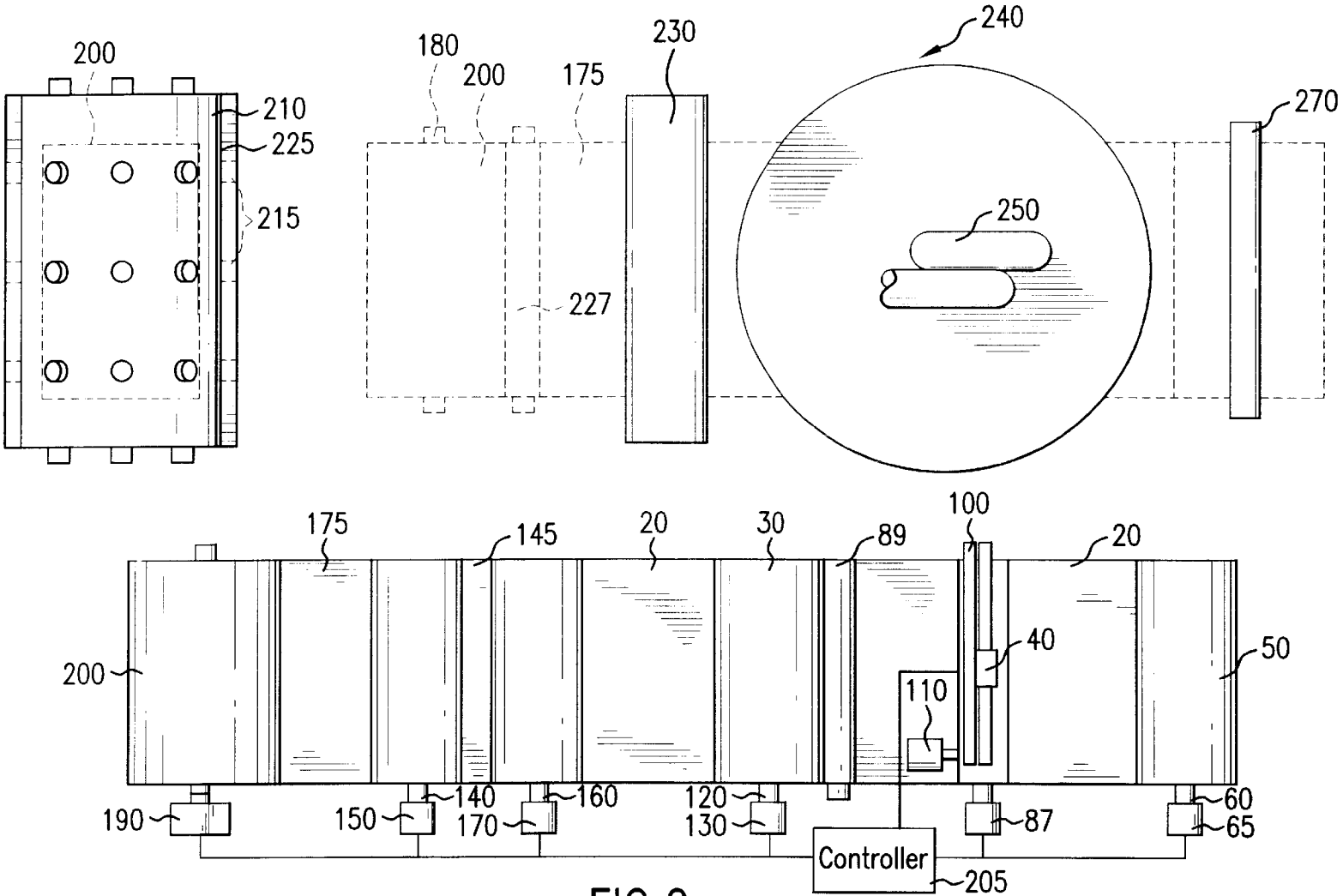
FIG. 2 is a plan view of the printer system.
Figure 6A:
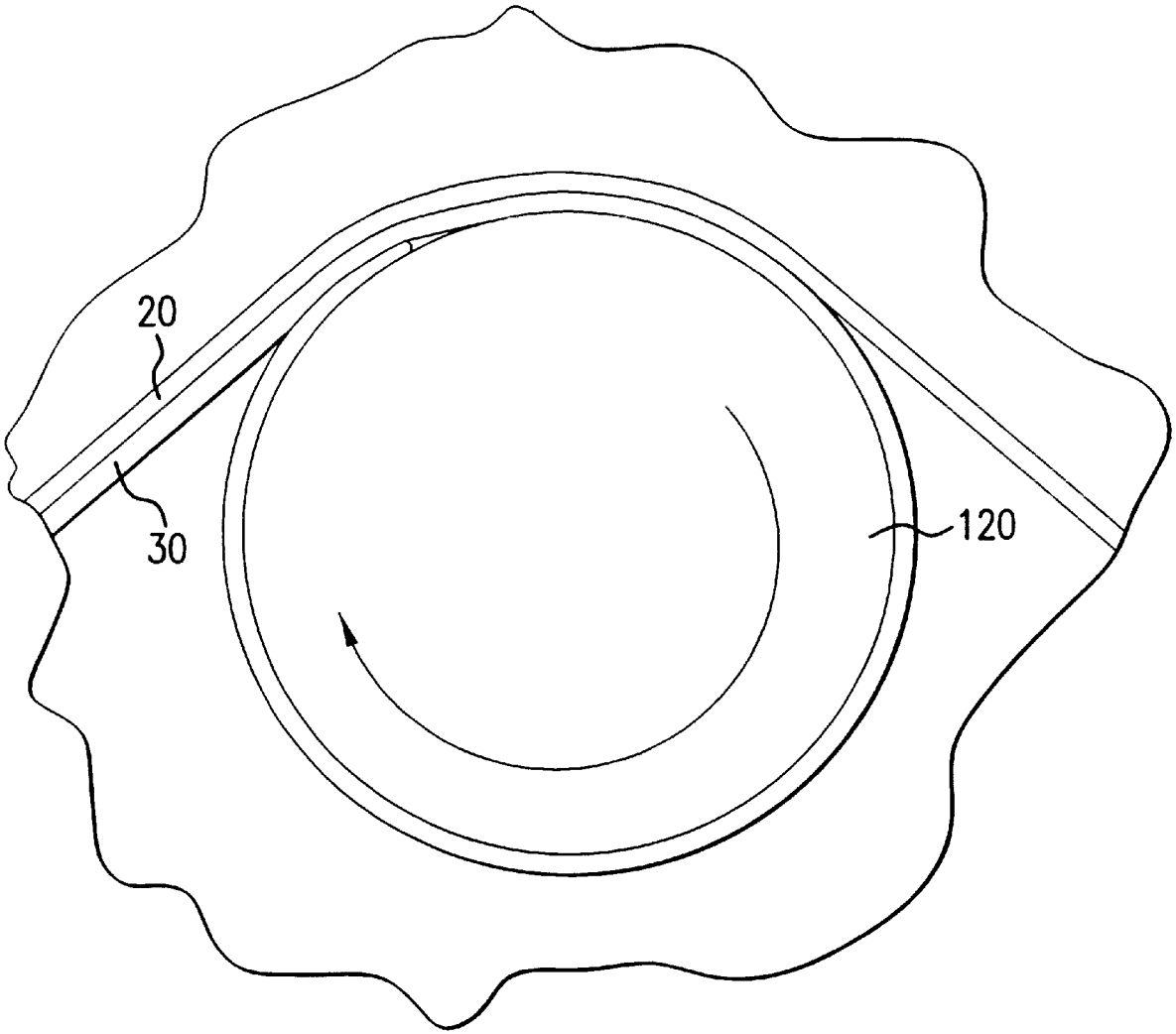
FIG. 6A is a fragmentation view in elevation of a first embodiment roller removing the substrate from the web.

Therefore, referring to FIGS. 1, 2 and 6A, aligned with platen 80 is a first work station, such as a generally cylindrical and rotatable first roller 120, for mechanically removing (i.e., peeling) substrate 30 from web 20. First roller 120 may be coupled to a fourth motor 130 for rotating first roller 120. The attendant assigned to operate printer system 10 threads web 20 and substrate 30 from platen 80 by any convenient means such as manually or mechanically. The attendant then separates a diminimus portion of substrate 30 from web 20 and wraps that portion of substrate 30 at least partially around first roller 120. For example, the attendant may wrap that portion of substrate 30 approximately one to one and one half times around first roller 120, if desired. That is, the attendant need only peel and wrap a sufficient amount of substrate 30 around first roller 120 so that substrate 30 avoids slipping on first roller 120 as first roller rotates by means of fourth motor 130. In this manner, as first roller 120 is caused to rotate, first roller 120 will mechanically peel the remainder of substrate 30 from web 20 after web 20 and substrate 30 feed past print head 40.

Referring again to FIGS. 1, 2 and 6A, aligned with first roller 120 is a second work station, such as a generally cylindrical and rotatable second roller 140. As described more fully hereinbelow, second roller 140 is adapted to layer a covering 145 onto web 20 as second roller 140 rotates and as first roller 120 peels substrate 30 from web 20. Second roller 140 may be coupled to a fifth motor 150 for rotating second roller 140. The attendant assigned to operate printer system 10 threads the portion of web 20, from which substrate has been separated, into engagement or contact with second roller 140, as shown. The attendant may thread that portion of web 20 into engagement with second roller 140 by any convenient means, such as manually or mechanically.

Figure 6B:
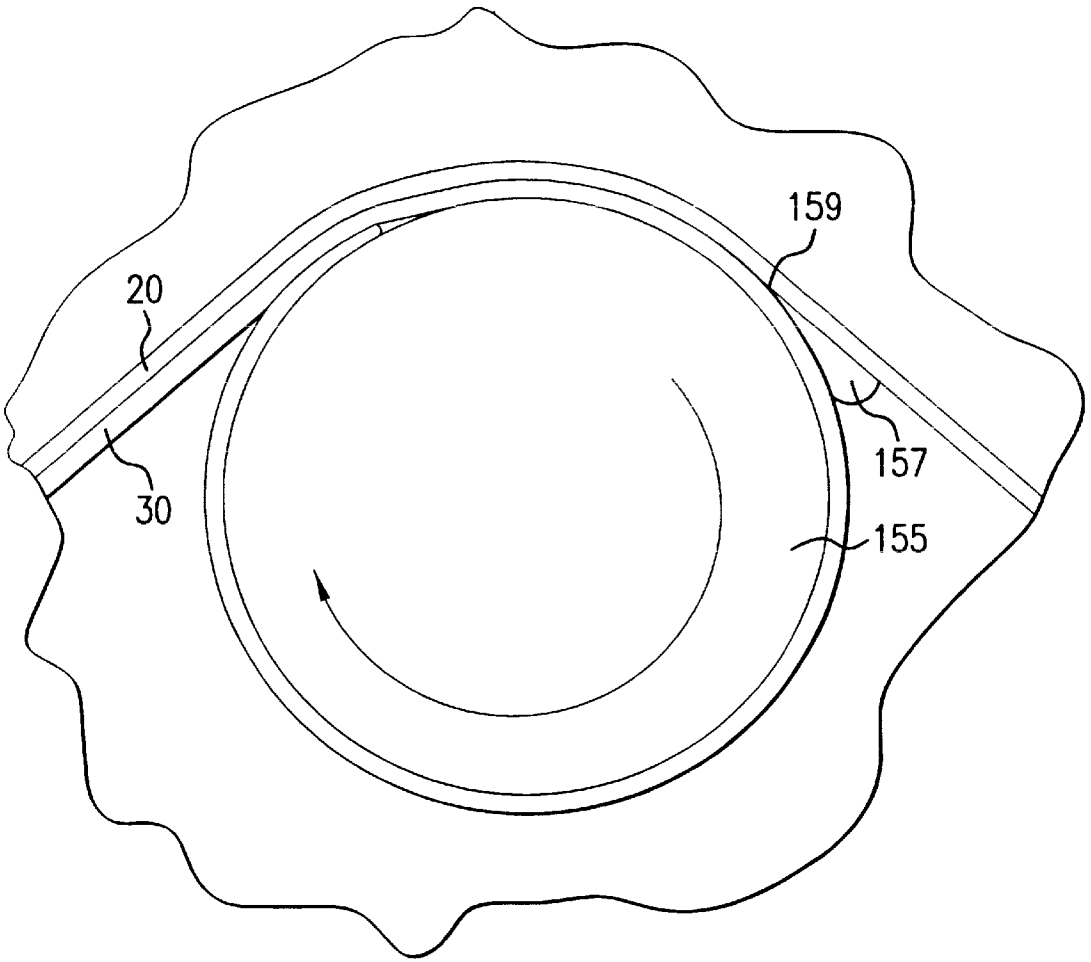
FIG. 6B is a fragmentation view in elevation of a second embodiment roller removing the substrate from the web.

Turning now to FIG. 6B, there is shown a second embodiment first roller 155. Second embodiment first roller 155 is substantially similar to first embodiment first roller 120, except that second embodiment first roller 155 includes an elongate knife edge or blade 157 having a sharp edge portion 159. The sharp edge portion 159 is capable of engaging the interface between web 20 and substrate 30 for easing separation of web 20 from substrate 30.

Returning to FIGS. 1, 2 and 6A, aligned with second roller 140 is a third work station, such as a generally cylindrical and rotatable third roller 160 having a supply of the covering 145 wound thereabout. The purpose of third roller 160 is to supply covering 145 to second roller 140 as third roller 160 rotates, such as by operation of a sixth motor 170. In this regard, the attendant grasps a free end of covering 145 and threads the free end of covering 145 into engagement or contact with second roller 140 such that covering 145 is interposed between web 20 and second roller 140. In this manner, covering 145 is caused to layer web 20 as web 20 and covering 145 engage second roller 140. Thusly, web 20 with covering 145 layered thereon defines a layered web 175. The purpose of covering 145 is to cover printed image 15, so that image 15 is not damaged during subsequent handling and to prevent "bleed through" of the ink forming image 15. That is, covering 145 separates successive layers of web 20 when web 20 and covering 145 are bundled-up (rolled-up) into a "steaming roll" prior to steaming. In this manner, ink from the top surface of web 20 in one layer of the steaming roll will not contact the bottom surface of the web in an adjacent layer of the steaming roll. Covering 145 may be paper or plastic.

Referring to FIGS. 1 and 2, aligned with second roller 140 is a bundling station, such as a solid and generally cylindrical steaming core 180, which supports a flexible mesh material, such as a cylindrical wire mesh 185 having a relatively low mesh count. Mesh 185 defines openings (not shown) to allow steam therethrough, for reasons disclosed presently. The attendant threads layered web 175 into engagement with mesh 185 and wraps a portion of layered web 175 about mesh 185. The attendant may wrap the portion of layered web 175 about one and one half turns around mesh 185, so that layered web 175 avoids slipping on mesh 185 as steaming core 180 is rotated. As steaming core 180 is rotated, such as by a seventh motor 190, layered web 175 will further wrap around mesh 185. Thus, it may be appreciated from the description hereinabove that mesh 185 is adapted to engage and bundle-up layered web 175, so that a steaming roll 200 is defined thereby.

Referring again to FIGS. 1 and 2, a controller 205 is electrically connected to first motor 65, second motor 87, third motor 110, fourth motor 130, fifth motor 150, sixth motor 170 and seventh motor 190 for synchronous rotation of motors 65/87/110/130/150/170/190. Controller 205 may be any suitable controller, such as is available from AmeriMex Motor & Controls, Incorporated located in Houston, Tex. (USA). Alternatively, only seventh motor 190 may be provided, if desired, and the other motors eliminated for reducing costs. In this case, seventh motor 190 will have been selected so as to possess sufficient torque to pull web 20, substrate 30 and covering 145.

Still referring to FIGS. 1 and 2, a fixing station, such as a steam generator 210, is disposed to sealingly receive steaming roll 200 therein. In this regard, steam generator 210 is adapted to generate and deliver, such as through a plurality of steam nozzles 215, superheated steam permeating steaming roll 200 and its associated web 20 for fixing the ink to web 20. The superheated steam may have a temperature of approximately 100° C. to 110° C. and steaming roll 200 may reside in steam generator 210 a predetermined time depending on the web material and composition of ink. Steam generator 210 itself has a cover 220 rotatable about a hinge 225 for opening and closing steam generator 210, so that steaming roll 200 may be received into and extricated from steam generator 210.

Referring yet again to FIGS. 1 and 2, steaming roll 200 is removed from steam generator 210 by any convenient means such as manually or mechanically. Layered web 175 is then preferably unwound from steaming roll 200. As layered web 175 is unwound from steaming roll 200, covering 145 is removed from layered web 175, such as by means of a de-covering station or fourth roller 227 rotatable by a seventh motor (not shown). In this regard, the attendant peels a diminimus portion of covering 145 away from layered web 175 and wraps that portion of covering 145 around fourth roller 227. The attendant then directs the bare web 20 through a washing station 230 that washes unfixed ink from bare web 20. Thus, it may be understood from the description hereinabove, that removal of covering 145 from layered web 175 is accomplished in a manner substantially similar to removal of substrate 30 from web 20. In other words, covering 145 is preferably removed from layered web 175 prior to washing, thereby defining bare web 20. Moreover, a drying station, such as a hot-air blower generally referred to as 240, is disposed to direct a column of heated air onto bare web 20 for drying bare web 20 after bare web 20 is washed. Blower 240 may comprise an air pump 250 for blowing air across a resistance heater 260 in order to supply the heated air to bare web 20. Alternatively, bare web 20 may be left to naturally air-dry. In addition, a packaging station, such as a take-up reel 270, is aligned with washer 230 and is adapted to engage bare web 20 for wrapping bare web 20 around take-up reel 270. In this manner, layered web 175 is packaged for shipment to a suitable facility for cutting and sewing into articles for everyday use, such as clothing, towels, upholstery and other articles.

It may be understood from the description hereinabove that an advantage of the present invention is that use thereof decreases total printing time, labor and expense. This is so because substrate 30 is mechanically (i.e., automatically) removed from web 20 rather than being manually removed from web 20 and also because layered web 175 is formed automatically.

It may be further understood from the description hereinabove, that another advantage of the present invention is that use thereof decreases likelihood of damage to web 20, which in turn decreases wastage. This is so because manual manipulation of web 20 and substrate 30, along with the associated human error, is reduced.

While the invention has been described with particular reference to its preferred embodiments, it will be understood by those skilled in the art that various changes may be made and equivalents may be substituted for elements of the preferred embodiments without departing from the invention. For example, a radiant heater may be substituted for hot-air blower 240.

Therefore, what is provided is an ink jet printer system for printing an image on a web overlaying a removable substrate, and method of assembling the printer system, the printer system being capable of removing the substrate from the web.

PARTS LIST

10 . . . ink jet printer system
15 . . . image
20 . . . web
30 . . . substrate
40 . . . print head
50 . . . roll
60 . . . spindle
65 . . . first motor
70*a/b/c* . . . ink channels
72*a/b/c* . . . ink channel orifices
75*a/b/c* . . . ink in channels

80 . . . platen
85 . . . axle
87 . . . second motor
89 . . . capstan roller
90 . . . ink drop
100 . . . lead screw
110 . . . third motor
120 . . . first embodiment of first roller
130 . . . fourth roller
140 . . . second roller
145 . . . covering
150 . . . fifth motor
155 . . . second embodiment of first roller
157 . . . blade
159 . . . sharp edge portion
160 . . . third roller
170 . . . sixth motor
175 . . . layered web
180 . . . steaming core
185 . . . wire mesh
190 . . . seventh motor
200 . . . steaming roll
205 . . . controller
210 . . . steam generator
215 . . . steam nozzles
220 . . . cover
225 . . . hinge
227 . . . fourth roller
230 . . . washer
240 . . . hot-air blower
250 . . . air pump
260 . . . resistance heater
270 . . . take-up reel

What is claimed is:

1. An ink jet printer system for printing an image on a web overlaying a removable substrate, comprising:

a. a print head for jetting ink onto the web;

b. a feeder mechanism associated with said print head for feeding the web and substrate past said print head; and c. a first work station associated with said feeder mechanism for removing the substrate.

2. The system of claim 1, further comprising:

a. a second work station associated with said first work station, said second work station being adapted to layer a covering onto the web to define a layered web; and b. a third work station associated with said second work station for supplying the covering to said second work station.

3. The system of claim 2, further comprising a bundling station associated with said second work station, said bundling station being adapted to bundle-up the layered web.

4. The system of claim 3, further comprising a fixing station associated with said bundling station for fixing the ink to the web.

5. The system of claim 4, further comprising a de-covering station associated with said fixing station for removing the covering from the layered web.

6. The system of claim 5, further comprising a washing station associated with said fixing station for washing the web after removal of the covering from the layered web.

7. The system of claim 6, further comprising a drying station associated with said washing station for drying the web after washing of the web.

8. The system of claim 6, further comprising a packaging station associated with said fixing station, said packaging station being adapted to engage the web for packaging the web after drying of the web.

9. The system of claim 1, further comprising a blade associated with said first work station for removing the substrate.

10. An ink jet printer system for printing an image on a web overlaying a removable substrate, comprising:

a. an ink jet print head for jetting ink onto the web to form the image on the web;

b. a feeder mechanism coupled to said print head for feeding the web and substrate past said print head; and c. a first roller aligned with said feeder mechanism, said first roller being adapted to engage the substrate for removing the substrate from the web as the web and substrate are fed past said print head.

11. The system of claim 10 further comprising:

a. a second roller aligned with said first roller, said second roller being adapted to layer a covering onto the web to define a layered web as said first roller removes the substrate from the web; and b. a third roller aligned with said second roller for supplying the covering to said second roller.

12. The system of claim 11, further comprising a steaming core aligned with said second roller, said steaming core being adapted to engage and bundle-up the layered web therearound, so that a steaming roll is defined thereby.

13. The system of claim 12, further comprising a steam generator disposed to receive the steaming roll and generate steam contacting the web for fixing the ink to the web.

14. The system of claim 13, further comprising a fourth roller aligned with said steam generator and adapted to engage the covering for removing the covering from the layered web.

15. The system of claim 14, further comprising a washer disposed to wash the web for removing unfixed ink from the web after removal of the covering from the layered web.

16. The system of claim 15, further comprising a hot-air blower disposed to direct hot air onto the web for drying the web after washing of the web.

17. The system of claim 15, further comprising a take-up reel aligned with said washer, said take-up reel being adapted to engage the web and wrap the web thereabout for packaging the web on said take-up reel after drying of the web.

18. The system of claim 10, further comprising a blade coupled to said first roller for removing the substrate.

19. An ink jet printer system for printing an image on a web overlaying a removable substrate, comprising:

a. an ink jet print head having a plurality of ink jetting orifices for selectively jetting ink onto the web to form the image on the web;

b. a feeder mechanism coupled to said print head, said feeder mechanism being adapted to engage the web and substrate for feeding the web and substrate past said print head as said print head prints the image; and c. a cylindrical rotatable first roller aligned with said feeder mechanism for peeling the substrate from the web, said first roller being adapted to engage the substrate, peal the substrate from the web and wrap the substrate around said first roller as said first roller rotates and as the web and substrate are fed past said print head.

20. The system of claim 19, further comprising:

a. a cylindrical rotatable second roller aligned with said first roller, said second roller being adapted to layer a covering onto the web to define a layered web as said second roller rotates and as said first roller peals the substrate from the web; and b. a cylindrical rotatable third roller aligned with said second roller, said third roller having the covering wound thereabout, said third roller being adapted to supply the covering to said second roller as said third roller rotates.

21. The system of claim 20, further comprising a cylindrical rotatable steaming core aligned with said second roller, said steaming core being adapted to engage and bundle-up the layered web therearound as said steaming core rotates, so that a steaming roll is defined thereby.

22. The system of clam 21, further comprising a steam generator disposed to receive the steaming roll and generate superheated steam permeating the layered web for fixing the ink to the layered web.

23. The system of claim 21, further comprising a fourth roller aligned with said steam generator and adapted to engage the covering for removing the covering from the layered web.

24. The system of claim 23, further comprising a washer disposed to wash the web for washing-away unfixed ink from the web after removal of the covering from the layered web.

25. The system of claim 24, further comprising a hot-air blower disposed to dry the web after washing of the web.

26. The system of claim 22, further comprising a cylindrical rotatable take-up reel aligned with said washer, said take-up reel being adapted to engage the web and wrap the web thereabout as said take-up reel rotates for packaging the web on said take-up reel after drying of the web.

27. The system of claim 19, further comprising a blade associated with said first roller for removing the substrate.

28. A method of assembling an ink jet printer system for printing an image on a web overlaying a removable substrate, comprising the steps of:

a. providing a print head for jetting ink onto the web;

b. coupling a feeder mechanism to the print head for feeding the web and substrate past the print head; and c. coupling a first work station to the feeder mechanism for removing the substrate.

29. The method of claim 28, further comprising the steps of:

a. coupling a second work station to the first work station, the second work station being adapted to layer a covering onto the web to define a layered web; and b. coupling a third work station to the second work station for supplying the covering to the second work station.

30. The method of claim 29, further comprising the step of coupling a bundling station to the second work station, the bundling station being adapted to bundle-up the layered web.

31. The method of claim 30, further comprising the step of coupling a fixing station to the bundling station for fixing the ink to the web.

32. The method of claim 31, further comprising the step of coupling a de-covering station to the fixing station for removing the covering from the layered web.

33. The method of claim 32, further comprising the step of coupling a washing station to the fixing station for washing the web after removal of the covering from the layered web.

34. The method of claim 33, further comprising the step of coupling a drying station to the washing station for drying the web after washing of the web.

35. The method of claim 30, further comprising the step of coupling a packaging station to the fixing station, the packaging station being adapted to engage the web for packaging the web after drying of the web.

36. The method of claim 28, further comprising the step of coupling a blade to the first work station for removing the substrate.

37. A method of assembling an ink jet printer system for printing an image on a web overlaying a removable substrate, comprising the steps of:

a. providing an ink jet print head for jetting ink onto the web to form the image on the web;

b. coupling a feeder mechanism to the print head for feeding the web and substrate past the print heat; and c. aligning a first roller with the feeder mechanism, the first roller being adapted to engage the substrate for removing the substrate from the web as the web and substrate are fed past the print head.

38. The method of claim 37, further comprising the steps of a. aligning a second roller with the first roller, the second roller being adapted to layer a covering onto the web to define a layered web as the first roller removes the substrate from the web; and b. aligning a third roller with the second roller for supplying the covering to the second roller.

39. The method of claim 38, further comprising the step of aligning a steaming core with the second roller, the steaming core being adapted to engage and bundle-up the layered web therearound, so that a steaming roll is defined thereby.

40. The method of claim 39, further comprising the step of disposing a steam generator so as to receive the steaming roll and generate steam contacting the web for fixing the ink to the web.

41. The method of claim 40, further comprising the step of aligning a fourth roller with the steam generator, the fourth roller adapted to engage the covering so as to remove the covering from the layered web.

42. The method of claim 41, further comprising the step of disposing a washer so as to wash the web for removing unfixed ink from the web after removal of the covering from the layered web.

43. The method of claim 42, further comprising the step of disposing a hot-air blower so as to direct hot air onto the web for drying the web after washing of the web.

44. The method of claim 43, further comprising the step of aligning a take-up reel with the washer, the take-up reel being adapted to engage the web and wrap the web thereabout for packaging the web on the take-up reel after drying of the web.

45. The method of claim 37, further comprising the step of coupling a blade to the first roller for removing the substrate.

46. A method of assembling an ink jet printer system for printing an image on a web overlaying a removable substrate, comprising the steps of:

a. providing an ink jet print head having a plurality of ink jetting orifices for selectively jetting ink onto the web to form the image on the web;

b. coupling a feeder mechanism to the print head, the feeder mechanism being adapted to engage the web and substrate for feeding the web and substrate past the print head as the print head prints the image; and c. aligning a cylindrical rotatable first roller with the feeder mechanism for peeling the substrate from the web, the first roller being adapted to engage the substrate, peal the substrate from the web and wrap the substrate around the first roller as the first roller rotates and as the web and substrate are fed past the print head.

47. The method of claim 46, further comprising the steps of:

a. aligning a cylindrical rotatable second roller with the first roller, the second roller being adapted to layer a covering onto the web as the second roller rotates and as the first roller peals the substrate from the web; and b. aligning a cylindrical rotatable third roller with the second roller, the third roller having the covering wound thereabout, the third roller being adapted to supply the covering to the second roller as the third roller rotates.

48. The method of claim 47, further comprising the step of aligning a cylindrical rotatable steaming core with the second roller, the steaming core being adapted to engage and bundle-up the layered web therearound as the steaming core rotates, so that a steaming roll is defined thereby.

49. The method of clam 48, further comprising the step of disposing a steam generator so as to receive the steaming roll and generate superheated steam permeating the web for fixing the ink to the web.

50. The method of claim 49, further comprising the step of disposing a cylindrical rotatable fourth roller, the fourth roller adapted to engage the covering so as to remove the covering from the layered web.

51. The method of claim 50, further comprising the step of disposing a washer so as to wash the web for washing-away unfixed ink from the web after removal of the covering from the layered web.

52. The method of claim 51, further comprising the step of disposing a hot-air blower so as direct hot air onto the web to dry the web after washing of the web.

53. The method of claim 52, further comprising step of aligning a cylindrical rotatable take-up reel with the washer, the take-up reel being adapted to engage the web and wrap the web thereabout as the take-up reel rotates for packaging the web on the take-up reel after drying of the web.

54.The method of claim 46, further comprising the step of coupling a blade to the first roller for removing the substrate.

* * * * *

UNITED STATES PATENT AND TRADEMARK OFFICE

CERTIFICATE OF CORRECTION

PATENT NO. : 6,561,642 B2
DATED : May 13, 2003
INVENTOR(S) : Gonzalez

It is certified that error appears in the above-identified patent and that said Letters Patent is hereby corrected as shown below:

Column 10,
Line 66, delete "peals" and insert therefor -- peels --.

Column 12,
Line 10, delete "heat" and insert therefor -- head --.
Line 65, delete "peals" and insert therefor -- peel --.

Column 13,
Line 6, delete "peals" and insert therefor -- peels --.

Signed and Sealed this

Twenty-first Day of June, 2005

JON W. DUDAS
*Director of the United States Patent and Trademark Office*